US005738017A

United States Patent [19]

Behringer

[11] Patent Number: 5,738,017

[45] Date of Patent: Apr. 14, 1998

[54] RAIL VEHICLE REVERSE MOVEMENT PREVENTION ASSEMBLY

[75] Inventor: Georg Behringer, Denzlingen, Germany

[73] Assignee: Heinrich Mack GmbH & Co., Waldkirch, Germany

[21] Appl. No.: 678,189

[22] Filed: Jul. 11, 1996

[30] Foreign Application Priority Data

Jul. 15, 1995 [DE] Germany ..... 195 25 845.2

[51] Int. Cl.[6] ..... B61K 7/00

[52] U.S. Cl. ..... 104/250; 104/249; 188/82.4; 187/359

[58] Field of Search ..... 104/249, 250, 104/251; 187/359; 188/82.1, 82.4, 82.7, 82.8

[56] References Cited

U.S. PATENT DOCUMENTS 1,935,414 11/1933 Raber ..... 188/82.4
4,588,140 5/1986 Hirano ..... 188/82.4
5,325,790 7/1994 Drayer ..... 104/249
5,458,297 10/1995 Shinohara et al. ..... 188/82.4

FOREIGN PATENT DOCUMENTS 42 20 940 C1 10/1993 Germany .

*Primary Examiner*—Mark T. Le
*Attorney, Agent, or Firm*—Reid & Priest LLP

[57] ABSTRACT

A rail vehicle has a pivotal latch pivotally mounted to its frame so that gravity urges one end of the locking latch toward a rack extending along the railway on which the rail vehicle is positioned for movement. A smooth slideway extends parallel to and adjacent the rack and a rocker arm pivotally mounted on the locking latch has a lower end pivotally urged by gravity into contact with the slideway so that forward movement of the rail vehicle pivots the rocking arm to cause the locking latch to be pivoted upwardly out of contact with the rack with any initiation of rearward movement causing reverse pivoting of the rocker arm to lower the locking latch into engagement with the rack to prevent further reverse movement of the vehicle. Maintaining the locking latch out of contact with the rack during forward movement reduces wear and avoids the generation of clacking noise during forward movement of the vehicle.

19 Claims, 2 Drawing Sheets

F
10
12
14
16
17
18
20
22
24
26
26
28
30
32
34
36

RAIL VEHICLE REVERSE MOVEMENT PREVENTION ASSEMBLY

BACKGROUND OF THE INVENTION

The invention pertains to a gravitationally actuated reverse movement preventing assembly for a rail vehicle supported on a track along which a rack extends with the assembly including a locking latch which is held out of contact with the rack during forward movement of the rail vehicle but is automatically moved into engagement with the rack in response to initiation of reverse movement of the rail vehicle so as to terminate such reverse movement.

At amusement parks as well as festivals and similar activities, different rail vehicles are frequently built for entertainment such as roller coasters, bobsled runs, wild water runs and many more. All of these railways have one thing in common, namely they do not have individual drive units to each of the individual rail vehicles which are moved by drag chains or the like as well as by the force of gravity, and they are limited to a close circular course.

Thus, at the beginning of the ride, the individual vehicles or groups of vehicles are dragged upwardly at an angle to a certain height and released from which point on the rest of the vehicle ride is controlled by gravity and momentum. In order to prevent reverse travel when the vehicles are pulled up with a drag chain along the incline which is often very steep, for example if the chain fails or if the drive motor fails, each vehicle is provided with a respective reverse movement preventing device which act to stop reverse movement of the carriages. These types of devices are designed mainly as latch-locks which engage a fixedly positioned rack thus preventing reverse travel. This method of solving the problems results in considerable generation of "clacking" noise since the latches and racks consist of metal for reasons of strength and each locking latch sequentially drops into each step of the rack during upward movement of the vehicle along the rail.

A back stop for a railway of the above type is disclosed in German Patent Application DE 42 20 940 C1 in which a special configuration of the locking latch is provided for prevention of the noise caused by the continual repetitive engaging of the locking latches into the rests of the associated racks. Indeed, the aforementioned known arrangement leads to the desired reduction in noise, but is highly complicated and thus costly.

The primary object of the present invention is to provide a new and improved reverse movement preventing apparatus for rail vehicles which is of simplified construction and reduced cost.

A further object of the invention is the provision of a new and improved reverse movement prevention locking latch means for rail vehicles which is disengaged from an associated rack during forward travel of the vehicles but immediately engages the rack in response to the initiation of reverse movement.

SUMMARY OF THE INVENTION

The foregoing objects are achieved by the provision of at least one rocker arm on the vehicle which works in conjunction with the locking latch and which holds the locking latch out of contact with the rack during forward travel of the vehicle but which immediately guides the locking latch to engagement into the rack in response to the initiation of any reverse movement of the vehicle so as to immediately terminate such reverse movement. The rocker arm thus serves to hold the locking latch away from the associated rack at a distance during forward vehicle movement (allowed operation). In this case and in what follows, allowable operation is understood to be the planned upward travel of the associated vehicle. As soon as an interruption in the forward travel and the resulting beginning of backward vehicle travel due to the incline of the rails occurs, the rocker arm stops acting as a separator so that the locking latch immediately engages the rack to preclude any additional retrograde movement of the vehicle.

According to a preferred embodiment of the invention, at least one rocker arm is pivotally linked on one end to the locking latch with a free end of the rocker arm being supported on a slideway on which the rocker arm travels in sliding frictional engagement. This results in the rocker arm holding the locking latch away from engagement with the rack or bringing it into engagement with the rack, depending on the direction of vehicle travel.

A further advantage is achieved by the employment of a rest arranged on the locking latch for the rocker arm which keeps the rocker arm in the desired position. Another advantage of the invention flows from the fact that the rest is adjustable and thus adjusts the stop position of the rocker arm. It is consequently possible to arrange the rocker arm at a right angle to the slideway during allowable forward operation.

A maximum distance of the locking latch from the rack is maintained in a simple fashion so that positional changes of the rack which result in its movement toward the latch does not result in noise creating contact of the latch with the rack. Also in this way, it is guaranteed that an out-of alignment tilt of the rocker arm as a result of a possible overshoot past dead center can be prevented.

According to a further advantage of the invention, the slideway which is preferably made of a wear-resistant material and upon which the rocker arm is guided with light frictional resistance or with drag, is arranged parallel to the rack.

According to a preferred embodiment of the invention, the slideway can be made of a polymeric synthetic, for example, polyamide, acrylonitrile-butadiene-styrene copolymer (ABS) or polytetrafluoroethylene.

According to yet another embodiment of the invention, two rocker arms can be provided which are hinged on opposite sides of the locking latch with each rocker arm having its own slideway which is arranged on one side of the rack.

Another configuration of the back stop according to the invention has the forward edge of the rocker arm support surface lying against the slideway is chamfered or curved. In this way, the rocker arm glides past any ridges and projections of the slideway without disturbance so that a jolting or blocking of the rocker arm during the upward travel of the associated vehicle is avoided.

DESCRIPTION OF THE PREFERRED EMBODIMENTS

Figure 1:
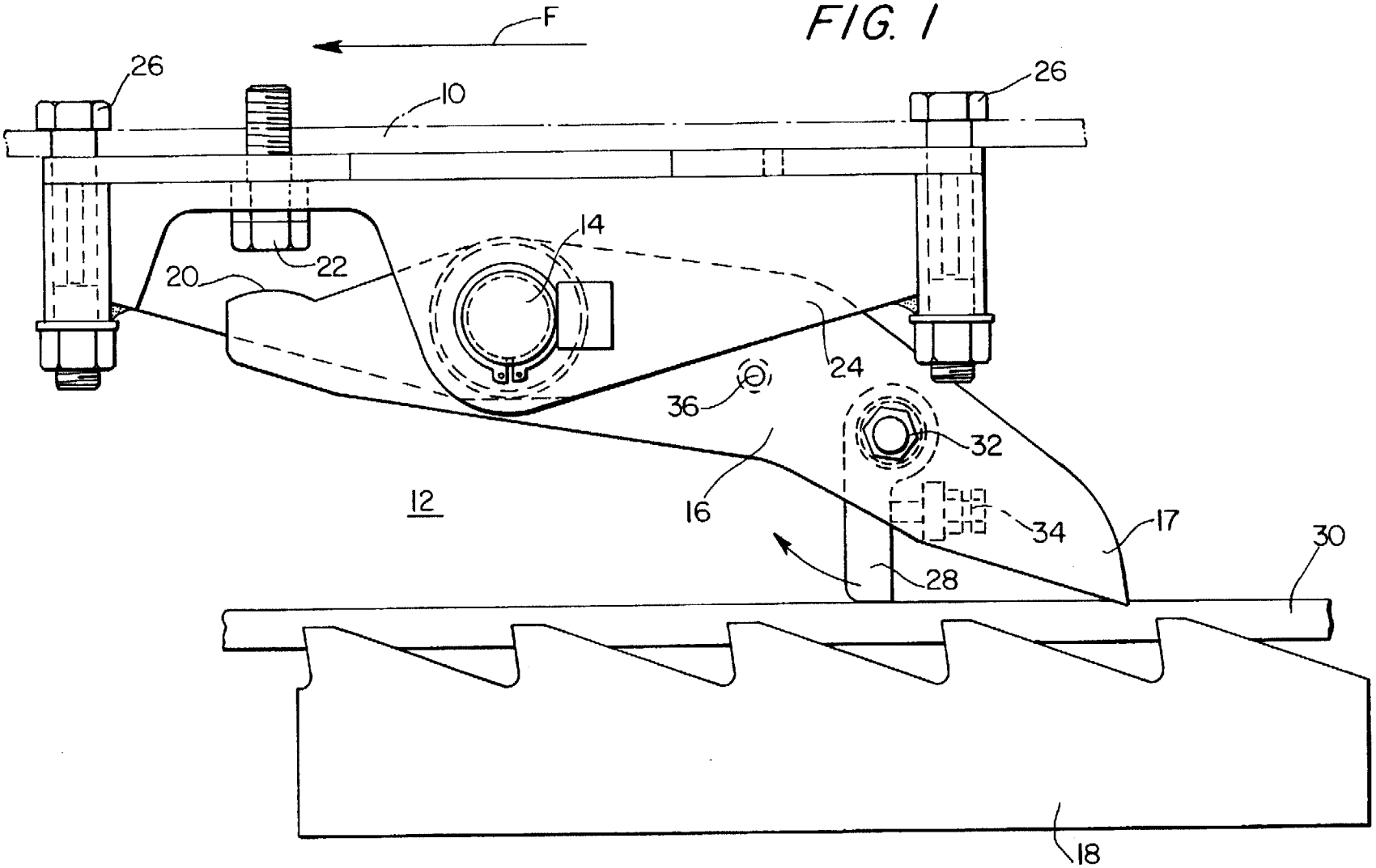
FIG. 1 is a side elevation of a reverse movement preventing assembly according to the invention in the traveling position.

FIG. 1 illustrates the lower region close to the rail of a rail vehicle 10 having a reverse movement preventing assembly 12 traveling in a forward direction to the left, as shown by the forward direction arrow F. The reverse movement preventing assembly 12 is fastened to the rail car by means of a main frame 24 and bolts 26 so that a sure anchoring is guaranteed.

This reverse movement preventing assembly which includes a locking latch 16 having a nose or distal end 17 and being pivotally mounted on the rail car 10 by a pivot pin 14 so that the force of gravity tends to rotate the locking latch in a clockwise direction. An associated rack 18 is immovably mounted on or relative to a rail (not shown) on which the rail vehicle 10 is mounted for movement in well-known manner. Locking latch 16 and rack 18 are in vertical alignment.

The pivot pin 14 is positioned from the left end of the locking latch approximately ¼ the length of the locking latch 16. The left end of the locking latch 16 has an abutment surface 20 which is engageable with a height adjusting screw 22 which adjusts the tilt limit position of the locking latch 16 in the clockwise direction. The engagement of nose 17 of the locking latch 16 with rack 18 when tripped, i.e. when an unplanned backward travel of the associated rail vehicle 10 is to be avoided, is effected by the action of gravity as a result of the eccentric positioning of pivot pin 14 relative to locking latch 16.

A rocker arm 28 is pivotally attached to the right end portion of the locking latch 16 by means of a tilt bearing or pivot pin 32. The lower end of the rocker arm 28 is supported on a planar slideway 30 and positions the locking latch 16 so that it is disengaged from the rack 18 when in the forward movement mode shown by arrow F of FIG. 1.

To limit the tilt path of the rocker arm 28, in particular to prevent counter-clockwise over tilting past the 90° vertical position of FIG. 1, an adjustable stop 34 is arranged at a distance from the tilt bearing 32. This stop 34 is adjustable using an adjusting screw to place the rocker arm 28 into a perpendicular position relative to the slideway during forward vehicle movement. Further, another rest 36 is likewise located on the locking latch 16 to prevent the rocker arm 28 from turning in a clockwise direction beyond rest 36.

Figure 2:
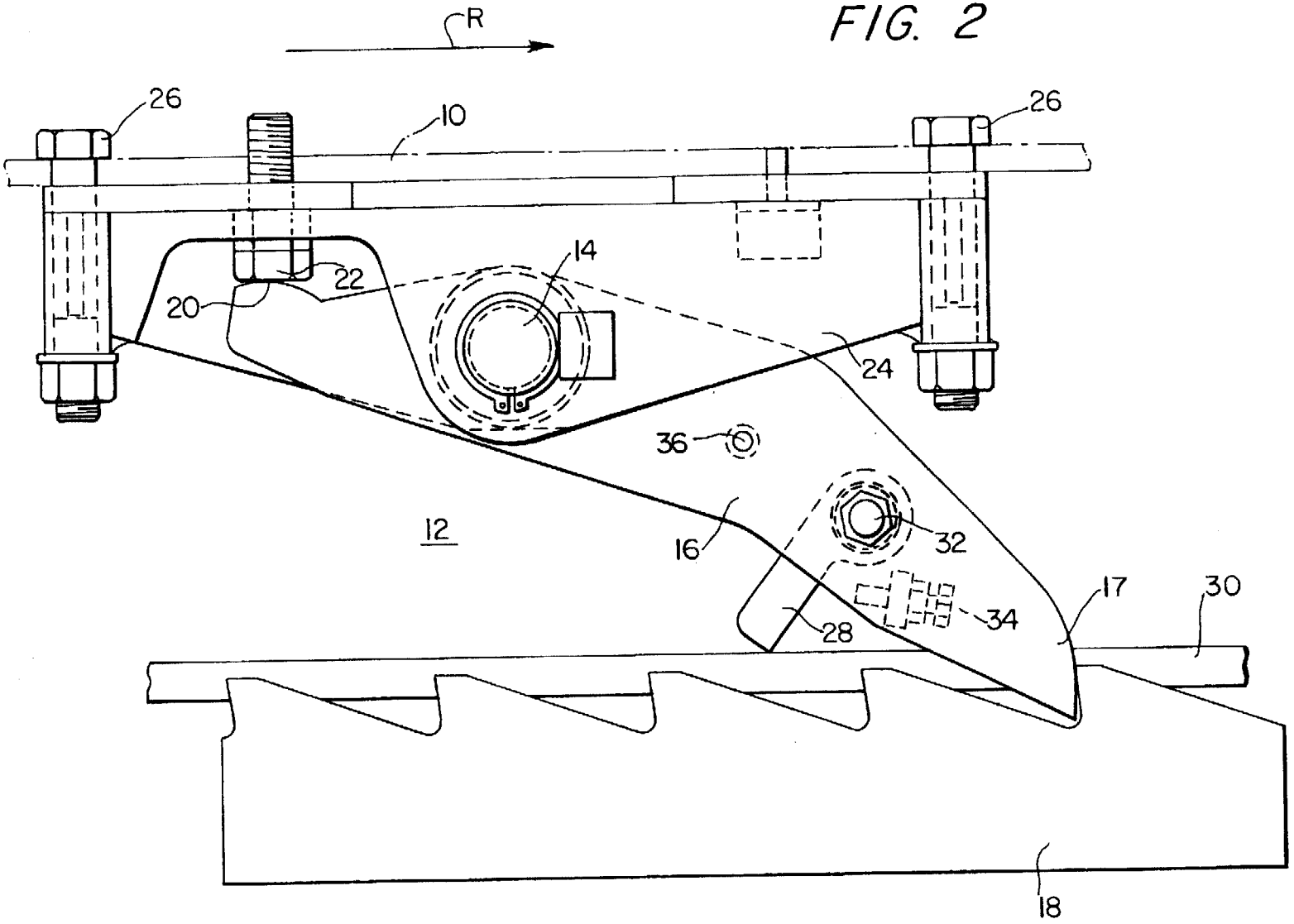
FIG. 2 is a view similar to FIG. 1 but showing the components in the locked reverse movement preventing position.

In FIG. 2, the position of the locking latch 16 has changed by clockwise rotation from the FIG. 1 position as a result of the initiation of reverse or backward vehicle 10 movement in the direction of arrow R. The nose 17 of locking latch 16 is consequently engaged into the rack so as to prevent further reverse movement of the vehicle 10. In order to release the locking latch 16 from this position, the vehicle must be moved forward, i.e. in the opposite direction so that rocker arm 28 will rotate in a counter-clockwise direction and lift the lower nose portion or distal end 17 out of contact with rack 16 and move the latch 50 to its FIG. 1 position. In operation, the locking latch nose 17 drops into the rack 18 automatically as a result of gravity as long as the rocker arm 28 does not prevent such movement. As long as the vehicle 10 moves forward, the rocker arm 28 is guided along the slideway 30 and urged by friction into a perpendicular position which is determined and maintained by the adjustable stop 34 and so as to hold the locking latch 16 in the FIG. 1 position.

In order to prevent blocking of the upward travel of the vehicle by the rocker arm 28 striking an obstruction on the slideway 30, the support surface of the rocker arm 28 lying on the slideway 30 is curved at its front edge so that the small irregularities in the slideway 30 can be ridden over and overcome without disturbance.

Since the rocker arm 28 is mounted so as to be easily tiltable and is held at dead center by the rest 34, only a minimal force is required, for example friction between the slideway 30 and the rocker arm 28, to tilt the rocker arm 28 from the perpendicular position according to FIG. 1 to the tipped position of FIG. 2.

The materials of which the rocker arm 28 and slideway 30 are formed are chosen with respect to the incident loads and the desired reduction in noise such that, on one hand, sufficient wear resistance is ensured, and on the other hand adequate frictional resistance exists between the slideway 30 and the lower end of the rocker arm 28 so as to cause the required pivotal movement of the rocker arm. It is also desirable that associated noise generation is kept sufficiently low. Preferably the upper surface of the slideway can be a polymer synthetic material such as polyamide, acrylonitrile-butadiene-styrene-copolymer (ABS) or polytetrafluoroethylene, for example. Both the slideway and rocker arm can be formed of steel. Alternatively, material can be employed on the surface of the rocker arm. For example, a suitable brake surface material can be employed as the wear material.

It should be understood that numerous modifications and variations from the disclosed preferred embodiments will be included within the present invention which is defined solely by the following claims. For example, it would be possible to use two rocker arms which are pivotally hinged on both sides of the locking latch 16 with each of the rocker arms having its own slideway arranged on opposite sides of the rack.

What is claimed is:

1. In a gravity-actuated reverse movement preventing assembly for a railway having a toothed rack extending along its length, a rail vehicle mounted for travel in a forward direction along the railway and a locking latch having first and second ends eccentrically pivotally mounted on the rail vehicle so that gravity tends to rotate a distal end of said locking latch into engagement with the rack to prevent movement of the rail vehicle in a reverse direction, the improvement comprising a rocker arm having an upper end pivotally mounted at one end on said locking latch and having a lower end spaced from said upper end, a slideway having a relatively flat upper surface extending lengthwise of said railway and positioned beneath said rocker arm so that said lower end of said rocker arm is urged into contact with said relatively flat upper surface and forward movement of the rail vehicle rotates the rocker arm in a first direction to a first position in which the rocker arm lifts and maintained the locking latch so that the locking latch is disengaged from the rack but wherein the initiation of reverse movement of the rail vehicle results in pivotal movement of the rocker arm in a reverse direction to permit the locking latch to be urged by gravity downwardly to move said distal end into engagement with the rack to prevent further reverse movement of the rail vehicle.

2. The reverse movement preventing assembly of claim 1 additionally including a stop means mounted on said locking latch for defining said first position of said rocker arm.

3. The reverse movement preventing assembly of claim 2 wherein said stop means is adjustable for adjustably defining said first position of said rocker arm.

4. The reverse movement preventing assembly of claim 1 wherein said slideway is parallel to said rack.

5. The reverse movement preventing assembly of claim 4 additionally including a stop means mounted on said locking latch for defining said first position of said rocker arm.

6. The reverse movement preventing assembly of claim 5 wherein said stop means is adjustable for adjustably defining said first position of said rocker arm.

7. The reverse movement preventing assembly of claim 1 wherein the upper surface of said slideway is formed of wear-resistant material.

8. The reverse movement preventing assembly of claim 7 additionally including a stop means mounted on said locking latch for defining said first position of said rocker arm.

9. The reverse movement preventing assembly of claim 8 wherein said stop means is adjustable for adjustably defining said first position of said rocker arm.

10. The reverse movement preventing assembly of claim 9 wherein said slideway is parallel to said rack.

11. A reverse movement preventing assembly as recited in claim 7 wherein said wear resistant material is a synthetic polymer.

12. A reverse movement preventing assembly as recited in claim 11 wherein said synthetic polymer is selected from the group consisting of polyamide, acrylonitrile-butadiene-styrene copolymer (ABS) and polytetrafluoroethylene.

13. A reverse movement preventing assembly as recited in claim 1 wherein said rocker arm pivot axis is perpendicular to the slideway.

14. The reverse movement preventing assembly of claim 1 wherein said distal end of said rocker arm has a curved surface facing in the forward direction of movement of said rail vehicle.

15. The reverse movement preventing assembly of claim 14 additionally including a stop means mounted on said locking latch for defining said first position of said rocker arm.

16. The reverse movement preventing assembly of claim 15 wherein said stop means is adjustable for adjustably defining said first position of said rocker arm.

17. The reverse movement preventing assembly of claim 16 wherein said slideway is parallel to said rack.

18. The reverse movement preventing assembly of claim 1 additionally including stop means for limiting pivotal movement of said rocker arm to approximately ninety degrees.

19. The reverse movement preventing assembly of claim 18 wherein said rocker arm is oriented substantially perpendicular to said slideway when said rocker arm is in its first position.

* * * * *

UNITED STATES PATENT AND TRADEMARK OFFICE

CERTIFICATE OF CORRECTION

PATENT NO. : 5,738,017
DATED : April 14, 1998
INVENTOR(S) : GEORG BEHRINGER

It is certified that error appears in the above-identified patent and that said Letters Patent is hereby corrected as shown below:

Title page, item [73],
On the cover page, under "Assignee", "Heinrich Mack GmbH & Co." should read --Heinrich Mack GmbH & Co. Karussell-und Fahrzeubau, Parkeinrichtungen--.

Signed and Sealed this
Twenty-second Day of September, 1998

*Attest:*

Bruce Lehman

BRUCE LEHMAN

*Attesting Officer*

*Commissioner of Patents and Trademarks*